US007540449B2

(12) United States Patent
Jenkins et al.

(10) Patent No.: US 7,540,449 B2
(45) Date of Patent: Jun. 2, 2009

(54) METHODS AND APPARATUS FOR NON-IMAGING GUIDANCE SYSTEM

(75) Inventors: David G. Jenkins, Tucson, AZ (US); Byron B. Taylor, Tucson, AZ (US); Richard C. Juergens, Tucson, AZ (US)

(73) Assignee: Raytheon Company, Waltham, MA (US)

( * ) Notice: Subject to any disclaimer, the term of this patent is extended or adjusted under 35 U.S.C. 154(b) by 66 days.

(21) Appl. No.: 11/548,968

(22) Filed: Oct. 12, 2006

(65) Prior Publication Data

US 2008/0087761 A1 Apr. 17, 2008

(51) Int. Cl.
*F41G 7/00* (2006.01)
*F42B 15/01* (2006.01)
*F42B 15/00* (2006.01)

(52) U.S. Cl. ..... 244/3.16; 244/3.1; 244/3.15

(58) Field of Classification Search ..... 244/3.1–3.3; 89/1.11

See application file for complete search history.

(56) References Cited

U.S. PATENT DOCUMENTS 2,423,885 A * 7/1947 Hammond ..... 244/3.16
2,457,393 A * 12/1948 Muffly ..... 244/3.16
2,513,367 A * 7/1950 Scott ..... 244/3.18
2,704,513 A * 3/1955 Dane, Jr. ..... 244/3.16
2,715,364 A * 8/1955 Buck et al. ..... 244/3.16
2,823,612 A * 2/1958 Cox et al. ..... 244/3.16
2,911,167 A * 11/1959 Null et al. ..... 244/3.16
2,922,100 A * 1/1960 Ketchledge ..... 244/3.16
3,025,023 A * 3/1962 Barghausen ..... 244/3.18
3,239,674 A * 3/1966 Aroyan ..... 244/3.18
3,268,185 A * 8/1966 Eckermann, Jr. ..... 244/3.18
3,293,437 A * 12/1966 Boydell ..... 244/3.16
3,311,747 A * 3/1967 Smith, Jr. et al. ..... 244/3.16
3,367,607 A * 2/1968 Bowen, Jr. ..... 244/3.16
3,786,757 A * 1/1974 Goldstein et al. ..... 244/3.16
3,793,958 A * 2/1974 Holt et al. ..... 244/3.16
3,923,381 A 12/1975 Winston
5,647,560 A * 7/1997 Schnatz et al. ..... 244/3.15
5,681,009 A * 10/1997 Vandersteen et al. ..... 244/3.16

FOREIGN PATENT DOCUMENTS

GB 2123949 A * 2/1984

* cited by examiner

*Primary Examiner*—Bernarr E Gregory
(74) *Attorney, Agent, or Firm*—The Noblitt Group, PLLC

(57) ABSTRACT

Methods and apparatus for a guidance system according to various aspects of the present invention comprise include an energy concentrator configured to transmit an energy entering the entrance through the exit if the energy enters the entrance within a predetermined acceptance angle, and reject the energy entering the entrance if the energy enters the entrance outside the predetermined acceptance angle. The system may further comprise a detector coupled to the exit of the energy concentrator and configured to generate signals corresponding to a location of the transmitted energy incident upon the detector.

28 Claims, 10 Drawing Sheets

METHODS AND APPARATUS FOR NON-IMAGING GUIDANCE SYSTEM

BACKGROUND

The ability of a guided projectile to track a particular target may be limited by the field of view (FOV) of the guidance system. A relatively narrow FOV may be unable to locate and track targets that fall outside of the FOV, while a larger FOV permits those targets to be tracked. For example, a semi-active laser homing (SALH) system may use a laser to designate a target. The laser radiation bounces off the target and scatters. A guidance system receives the reflected radiation and guides the projectile in the direction of the radiation reflection.

Most SALH targeting systems comprise a combination of detection devices and collection optics. The detection devices detect radiation emanating or reflected from a target, and may include thermal energy, a radar signal, laser energy, or the like. In many existing optical guidance systems, quad cell detectors are used, which tend to increase the expense of the guidance system.

Changing the FOV ordinarily involves increasing the size of the detector and altering the system's lenses. Altering the lenses of the guidance system, however, may reduce the system's effectiveness because less energy may be transmitted to the detector. In addition, increasing the size of the detector tends to add cost and increase package size.

SUMMARY OF THE INVENTION

Methods and apparatus for a guidance system according to various aspects of the present invention comprise an energy concentrator configured to transmit energy entering the entrance through the exit if the energy enters the entrance within a predetermined acceptance angle, and reject the energy entering the entrance if the energy enters the entrance outside the predetermined acceptance angle. The system may further comprise a detector coupled to the exit of the energy concentrator and configured to generate signals corresponding to the location of the transmitted energy incident upon the detector.

BRIEF DESCRIPTION OF THE DRAWINGS

Representative elements, operational features, applications and/or advantages of the present invention reside in the details of construction and operation as more depicted, described and claimed. Reference is made to the accompanying drawings, wherein like numerals typically refer to like parts.

Elements in the figures are illustrated for simplicity and clarity and have not necessarily been drawn to scale. For example, the dimensions of some of the elements in the figures may be exaggerated relative to other elements to help improve understanding of various embodiments of the present invention. Furthermore, the terms "first", "second", and the like herein, if any, are used for distinguishing between similar elements and not necessarily for describing a priority or a sequential or chronological order. Moreover, the terms "front", "back", "top", "bottom", "over", "under", and the like in the description and/or in the claims, if any, are generally employed for descriptive purposes and not necessarily for comprehensively describing exclusive relative position. Any of the preceding terms so used may be interchanged under appropriate circumstances such that various embodiments of the invention may be rendered capable of operation in other configurations and/or orientations than those explicitly illustrated or otherwise described.

DETAILED DESCRIPTION OF EXEMPLARY EMBODIMENTS

The following representative descriptions of the present invention generally relate to exemplary embodiments and the inventor's conception of the best mode, and are not intended to limit the applicability or configuration of the invention in any way. Rather, the following description is intended to provide convenient illustrations for implementing various embodiments of the invention, Changes may be made in the function and/or arrangement of any of the elements described in the disclosed exemplary embodiments without departing from the spirit and scope of the invention.

For example, various representative implementations of the present invention may be applied to any device for guiding a projectile or for other application in a detection or guidance system. A detailed description of an exemplary application, namely a non-imaging guidance system for a missile, is provided as a specific enabling disclosure that may be generalized to any application of the disclosed system, device, and method for guidance systems in accordance with various embodiments of the present invention.

Figure 1:
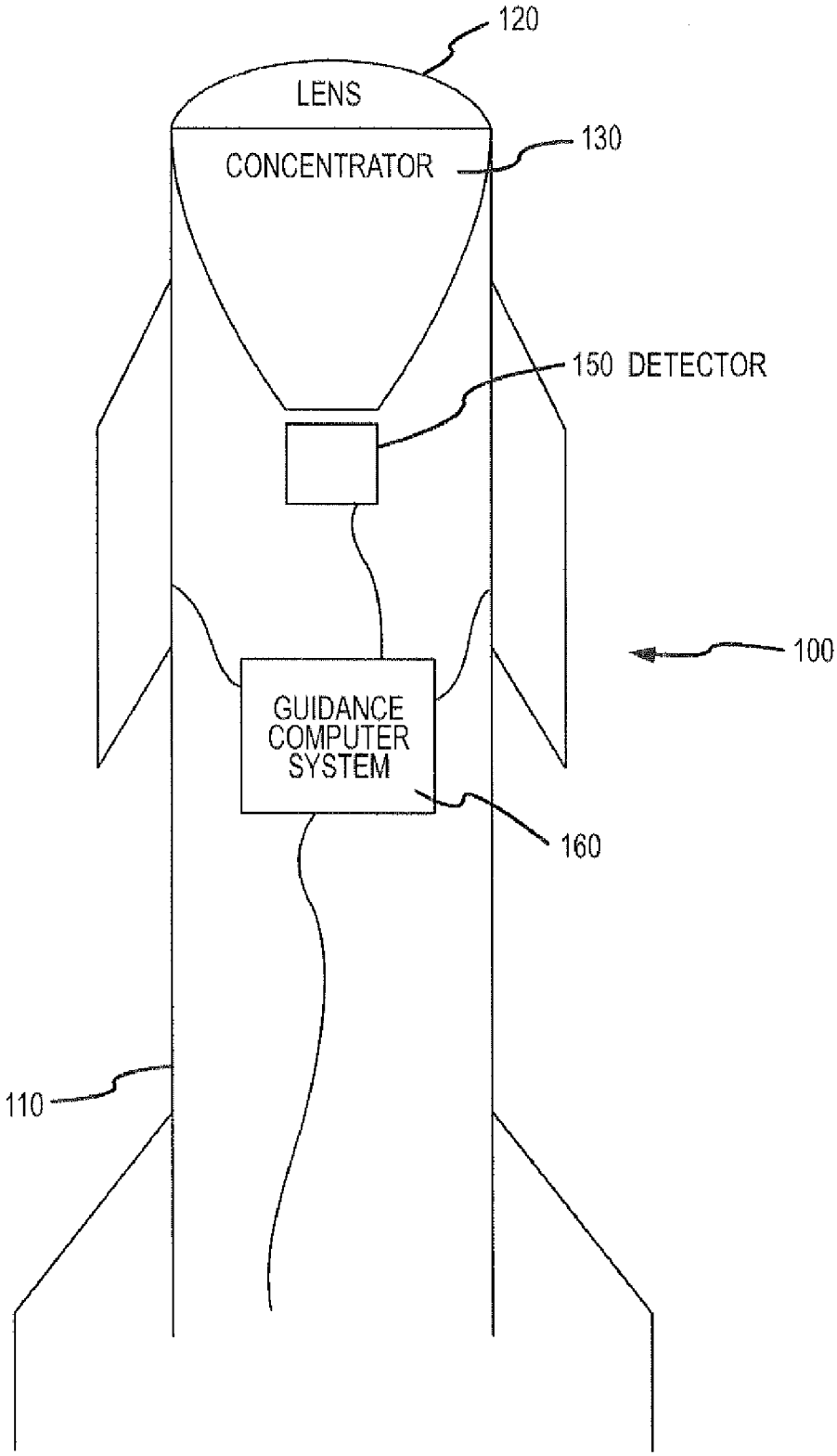
FIG. 1 is a cross-sectional view of a projectile including a guidance system.

Referring to FIG. 1, a guidance system 100 according to various aspects of the present invention operates to guide a projectile, such as a missile 110. The guidance system 100 may be configured to facilitate missile targeting by increasing the field of view (FOV) of the non-imaging guidance system 100, and/or may reduce the cost of the system by allowing for use of smaller and simpler components. In one embodiments the guidance system 100 comprises a non-imaging guidance system including a lens 120, a concentrator 130, a detector 150, and a guidance computer system 160 for guiding a missile 110. The missile 110 may contain all the components of the guidance system 100, which controls the trajectory of missile 110. In the present embodiment, the lens 120 focuses energy that passes through the non-imaging guidance system 100. The concentrator 130 collects energy that has passed through the lens 120 and selectively rejects the energy or transmits energy toward the detector 150. The detector 150 detects the presence of energy passing through the concentrator 130 and in response generates a signal which is communicated to the guidance computer system 160. The guidance computer system 160 receives the signal communicated from the detector 150 and controls the flight surfaces of the missile 10 to control its trajectory.

The missile 110 may comprise any system to be guided to a target, such as a conventional missile, a guided munition, cruise missile, or other guided projectile. In various embodiments, the missile 100 comprises control surfaces and a propulsion system such that the trajectory of the missile 110 may be altered by the guidance computer system 160. The missile 110 may comprise, for example, a military missile. The guidance system 100 may also be implemented in non-military applications, for example, in conjunction with private or commercial aircraft or space vehicles. Further, the guidance system 100 may be used for facilitating alignment of telescopes or other application requiring determination of the origin of an energy transmission.

The lens 120 directs energy entering the guidance system 100. The lens may comprise any system for directing energy, such as a conventional lens, mirror, or multiple lenses or mirrors. In the present embodiment, the lens 120 is coupled proximate a front portion of the missile 110, and may comprise any suitable material and configuration to direct energy to the concentrator 130. In laser-guided missile applications, for example, the lens 120 collects and focuses energy from a potential target towards the concentrator 130. The lens 120 may have a selected focal length according to the relative position of the concentrator 130. Alternatively, the lens 120 may be omitted from the guidance system 100. For example, the concentrator 130 may be the sole element for collecting and/or directing energy.

The concentrator 130 collects and directs energy toward the detector 150. The concentrator 130 may comprise any system for directing and/or concentrating energy, such as an imaging or a non-imaging concentrator 130. For example, the concentrator 130 may transmit energy entering the entrance through the exit if the energy enters the entrance within an acceptance angle, and reject the energy entering the entrance if the energy enters the entrance outside the acceptance angle, for example by reflection. The energy may comprise any suitable energy, such as electromagnetic waves, for example infrared radiation, visible light, laser radiation, or the like emitted by or reflected from a target.

Figure 3:
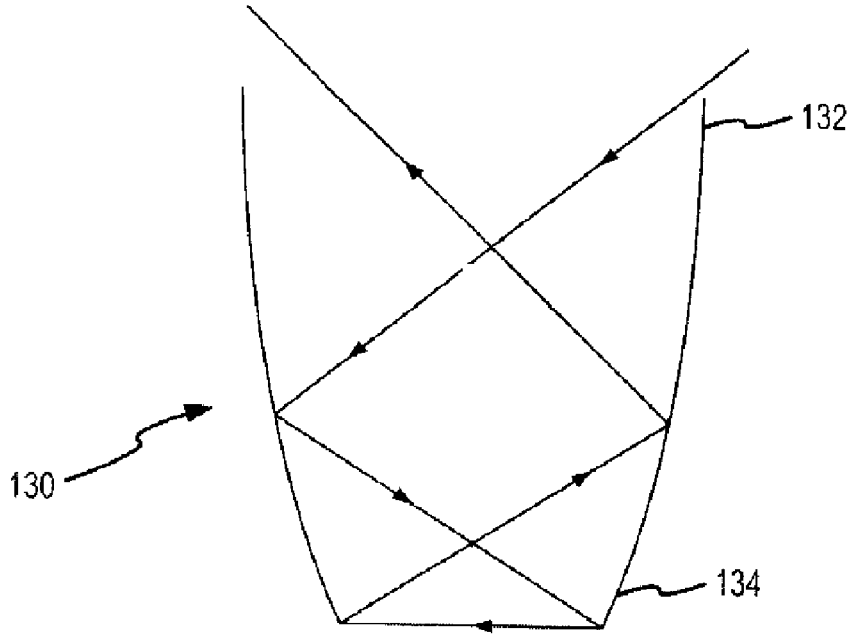
FIG. 3 is a cross-section view of a concentrator rejecting energy.
Figure 4:
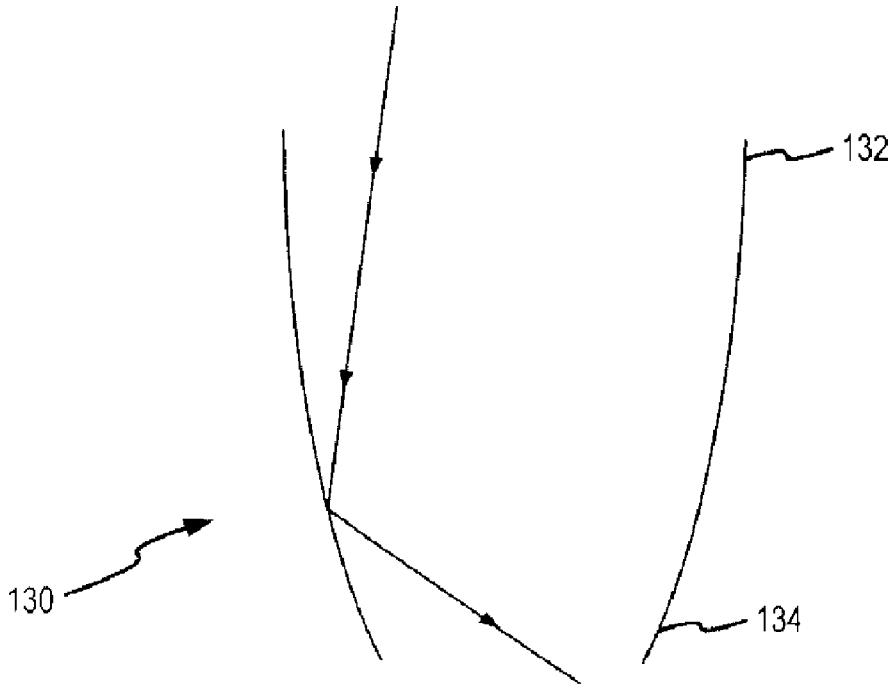
FIG. 4 is a cross-section view of a concentrator accepting energy.

In the present embodiment, the concentrator 130 comprises a non-imaging light collector, such as a compound parabolic concentrator, behind the lens 120. The concentrator may, however, comprise any appropriate concentrator, such as an imaging concentrator, a conical concentrator, a flowline concentrator, a concentrator having a hyperbolic profile, and the like. Referring to FIG. 3, the present concentrator 130 includes an entrance 132 and an exit 134. The concentrator 130 may be configured to reject energy that enters the entrance 132 at an angle above a particular acceptance angle $\theta_{accept}$. For example, such energy may be reflected back out of the entrance 132 of the non-imaging compound parabolic concentrator 130. Referring to FIG. 4, if energy enters the entrance 132 at an angle below the acceptance angle $\theta_{accept}$, then the energy is transmitted, for example through the exit 134. In this embodiment, energy entering the non-imaging concentrator 130 at an angle below $\theta_{accept}$ after passing through the lens 120 and transmitted by the concentrator is transmitted to the detector 150. Rejecting the light by reflecting the light out of the concentrator may improve stray light control.

The configuration of the concentrator 130 may be selected according to any relevant criteria. For example, the concentrator 130 may have a larger entrance aperture than the detector 150, which may increase the apparent size of the detector 150 and thus increase the apparent FOV of the guidance system 100 and/or facilitate the use of a smaller detector 150 while maintaining a desired FOV. In addition, the concentrator 130 may improve the signal strength by concentrating more energy onto the detector 150 and increasing the energy collected, especially at the edge of the FOV.

In addition, the concentrator 130 may be configured to establish an appropriate transfer function. The concentrator 130 may be configured to provide a steep transfer function for enhanced tracking accuracy without reducing the diameter of the energy spot transmitted by the concentrator 130. In addition, the concentrator 130 may be configured to set the acceptance angle at a selected degree, for example by selecting appropriate diameters for the entrance and the exit.

Figure 10:
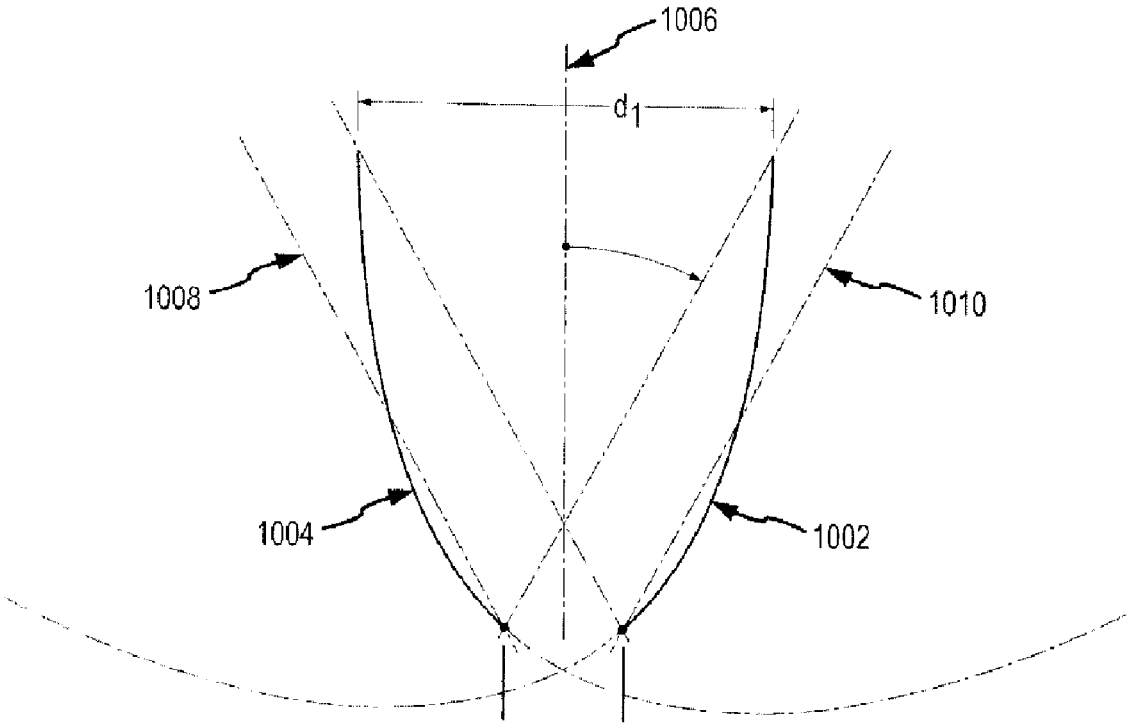
FIG. 10 is a cross-section view of a compound parabolic concentrator.

The concentrator 130 of the present embodiment comprises a compound parabolic concentrator. For example, referring to FIG. 10, the concentrator 130 may comprise two parabolic mirror segments 1002, 1004 coupled together along a central axis 1006. The two parabolic mirror segments 1002, 1004 are oriented such that the focal point of the first segment 1002 falls directly upon the second segment 1004 and vice versa. Each parabolic segment 1002, 1004 is generally symmetrical and has an axis 1008, 1010 that runs through the segment's focal point. The angle between one of the axes 1008, 1010 and the central axis 1006 is equal to the acceptance angle ($\theta_{accept}$) of the compound parabolic concentrator 130. The geometry of the two parabolic segments 1002, 1004 also defines the diameter of the exit 134 of the compound parabolic concentrator 130. For example, the diameter of the exit may be substantially identical to the distance between the two focal points of the parabolic segments 1002, 1004.

In the present embodiment, the various dimensions of the non-imaging concentrator 130 may be selected according to any appropriate criteria, such as according to the dimensions of the detector 150 and/or the focal length of lens 120. For example, if the detector 150 has a functional diameter $D_{detector}$, the diameter of the exit 134 may approximate that diameter. In the present embodiment, the diameter of the entrance 132 $D_{entrance}$ may be configured according to the parabolic shape and the diameter of the detector, such as according to the equation:

$$D_{entrance} = \frac{D_{detector}}{\sin(\theta_{accept})}$$

The focal length of the lens 120 may affect the placement of non-imaging concentrator 130. For example, the entrance 132 of the concentrator 130 may be located at approximately the focal-point of lens 120.

The concentrator 130 may increase the overall FOV for the non-imaging guidance system 100. The new FOV may be approximately calculated with the following equation:

$$FOV \cong \tan^{-1}\left(\frac{D_{concentrator}}{2 \cdot f_{lens}}\right)$$

Where $f_{lens}$ corresponds to the focal length of the lens 120. The FOV may be determined by selecting appropriate diameters of the concentrator 130. For example, to increase the FOV of a pre-existing guidance system having the detector 150 and lens 120, a concentrator 130 may be added. Alternatively, the concentrator 130 may facilitate deployment of a smaller and/or less expensive detector 150 while maintaining the original FOV available using a larger and/or more expensive detector 150. Thus, the concentrator 130 may facilitate selection of the FOV for a particular guidance system 100 without having to make substantial changes to the overall system 100. In addition, the concentrator 130 may comprise relatively low-cost parts, and may be fabricated in any suitable manner, such as conventional molding processes. Further, the concentrator may be reflective and accommodate energy generated by high-powered laser targeting systems. Moreover, a reflective non-imaging concentrator 130 may be less sensitive to thermal variations than other systems, such as a conventional optical lens system.

Figure 2:
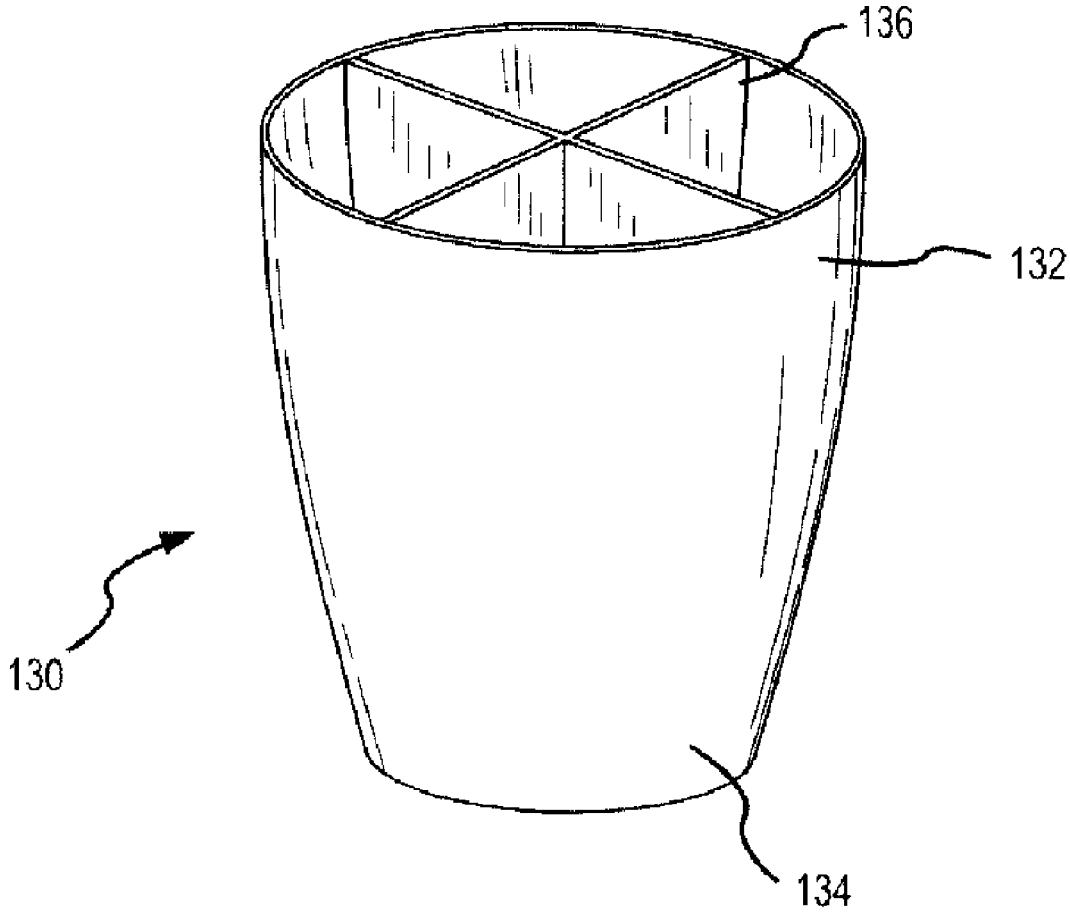
FIG. 2 is an oblique view of a concentrator having internal reflectors.
Figure 5:
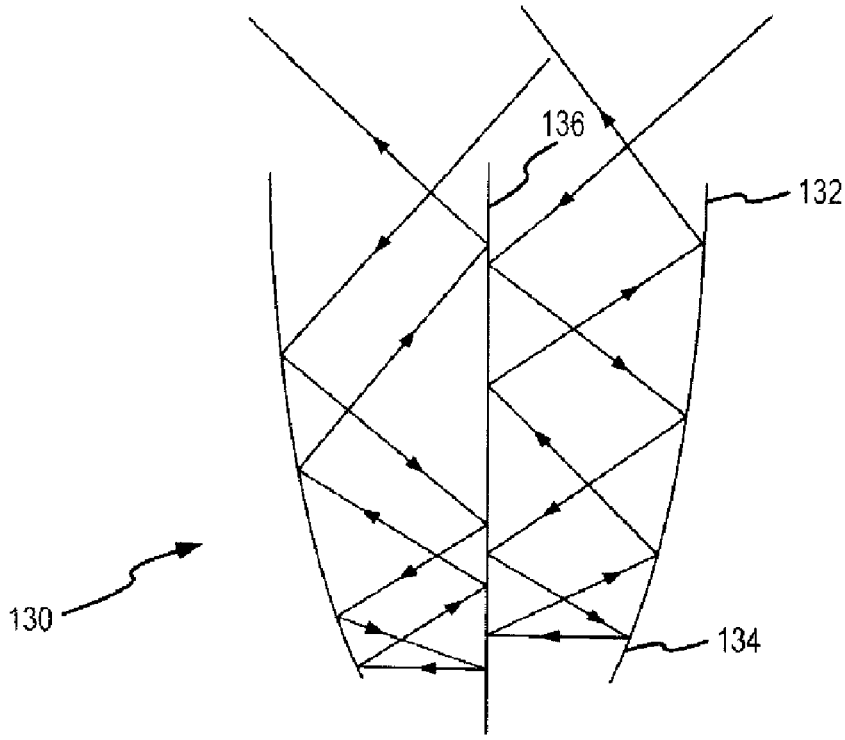
FIG. 5 is a cross-section view of a concentrator having an internal reflector and rejecting energy.
Figure 6:
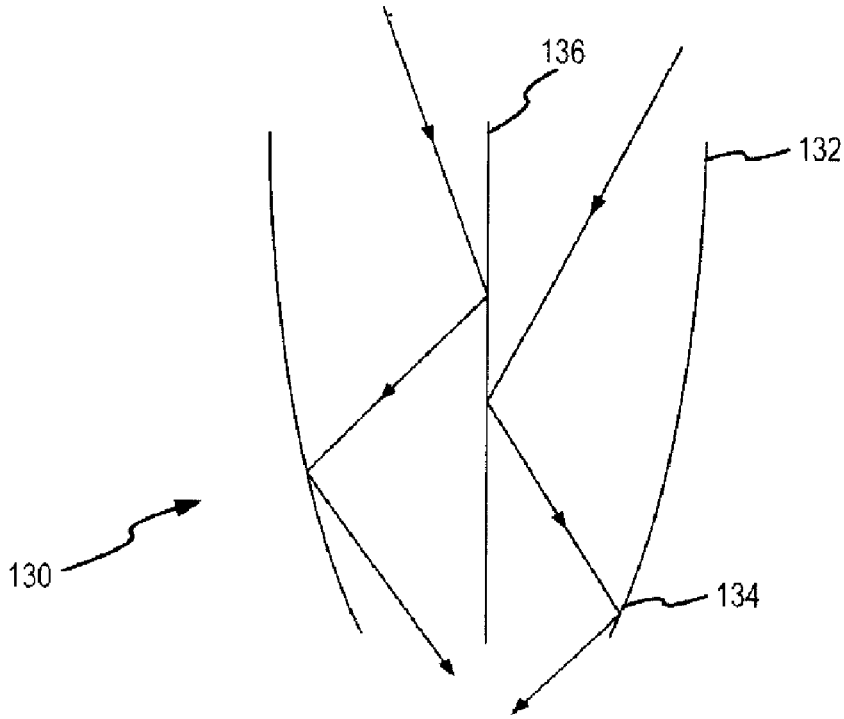
FIG. 6 is a cross-section view of a concentrator having an internal reflector and accepting energy.

The concentrator 130 may be configured to confine energy entering the concentrator 130 to selected areas, for example according to the point of entry of the radiation into the concentrator 130. In the present embodiment, the concentrator 130 may include two or more longitudinal sections that are configured such that energy entering the concentrator 130 in a particular section is confined to the same section. In the present embodiment, referring to FIGS. 2, 5, and 6, the non-imaging concentrator 130 comprises four sections defined by internal reflectors 136. The internal reflectors 136 reflect the relevant energy within the respective sections. By reflecting the energy within the section, the reflectors 136 inhibit crosstalk and interference caused by energy entering different sections of the non-imaging concentrator 130.

The internal reflectors 136 may comprise any suitable material for reflecting energy passing within the non-imaging concentrator 130 and preventing cross-talk. As energy travels through the non-imaging concentrator 130, the energy is reflected within the concentrator 130. Referring to FIG. 4, if the non-imaging concentrator 130 has no internal reflectors 136, energy may exit the concentrator 130 from a different section than the section the energy originally entered. Referring again to FIGS. 5 and 6, the internal reflectors 136 confine energy to the section of the concentrator 130 as the energy passes through the non-imaging concentrator 130, inhibiting cross-talk between the sections and promoting accuracy.

Figure 8:
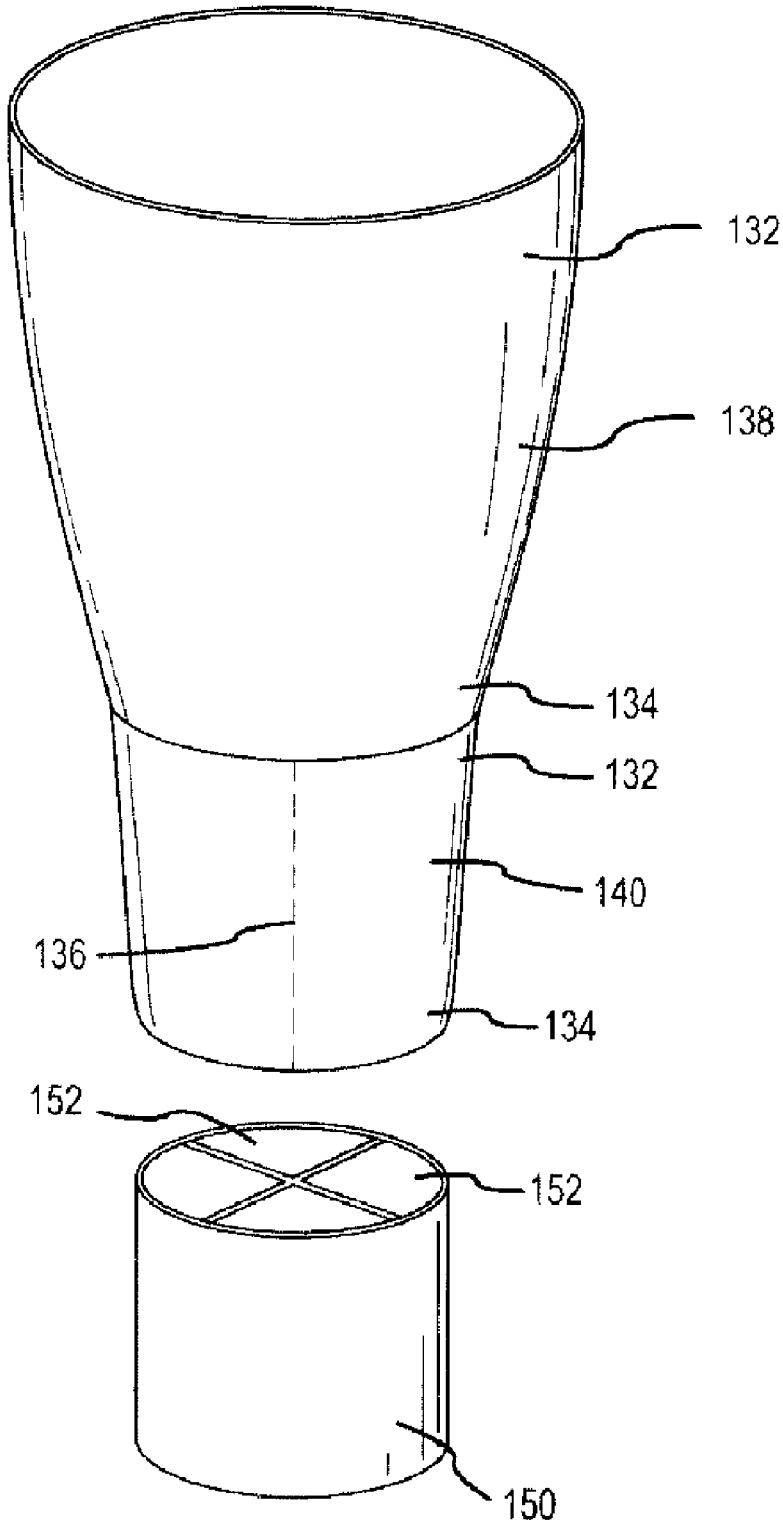
FIG. 8 is a side view of two concentrators coupled optically in series to a detection device.

The guidance system 100 may also comprise multiple concentrators 130 configured to effect desired optical characteristics. The concentrators 130 may be configured in any appropriate manner to direct energy to selected areas, reduce crosstalk, process different frequencies, control the FOV, and/or the like. For example, referring to FIG. 8, multiple concentrators 138, 140 may be coupled in series to further increase the overall FOV of the guidance system 100. Alternatively, three or more concentrators 138, 140 may be coupled in series to alter the optical properties of the non-imaging guidance system 100. Further, two or more concentrators 130, 140 may be coupled in parallel to direct energy to different detectors 150 or different areas of the same detector. For example, multiple concentrators 138, 140 in the same system 100 may gather and detect different types of energies, such as different frequencies, polarizations, and the like, that may pass through the guidance system 100. In one embodiment, different concentrators 138, 140 may be deployed to gather and detect different wavelengths, such as visible light and infra-red light.

In addition, different concentrators 138, 140 in a system may be configured according to the desired optical properties. For example, the various concentrators 138, 140 may have internal reflectors 136 and others may not. Further, additional concentrators 140 in a system may be constructed from or comprise appropriate materials, such as dielectric materials, for example to increase the FOV, as the concentration increases in proportion to the square of the index of the refraction of the dielectric material. Furthermore, the additional concentrators 140 may comprise or omit the internal reflectors 136.

Figure 9:
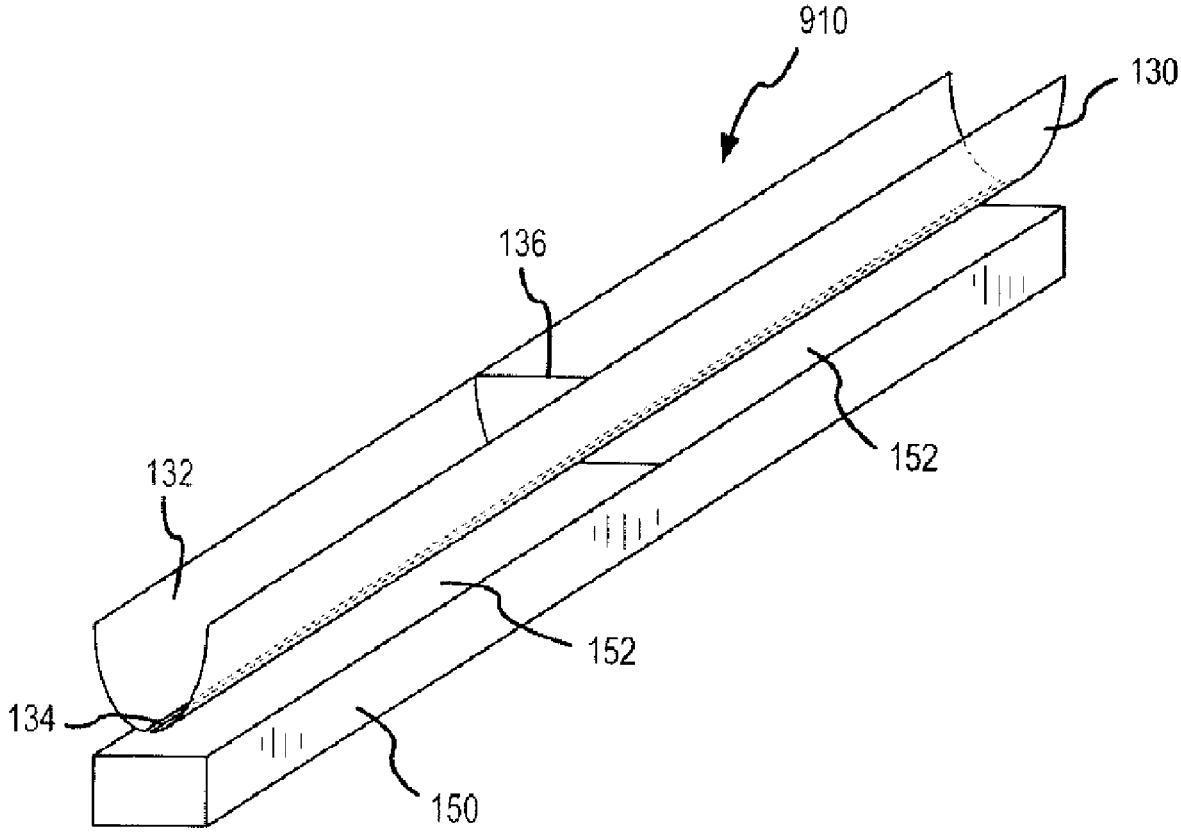
FIG. 9 is a perspective view of a concentrator having a trough configuration.

The non-imaging concentrators 138, 140 may further be configured in any appropriate configuration to direct energy. For example, the concentrator 138, 140 may comprise alternative geometrical configurations. Referring to FIG. 9, the concentrator 130 may comprise a trough compound parabolic concentrator 910 including two parabolic mirror segments and linear segments along a single axis. The trough compound parabolic concentrator 910 may include one or more internal reflectors 136 to inhibit energy crossing from one area of the trough compound parabolic concentrator 910 to another area. The concentrator 130 may also comprise conical concentrators, concentrators having hyperbolic profiles, or other appropriate configurations for directing energy, and may be selected according to the particular application of the optical system.

Figure 7:
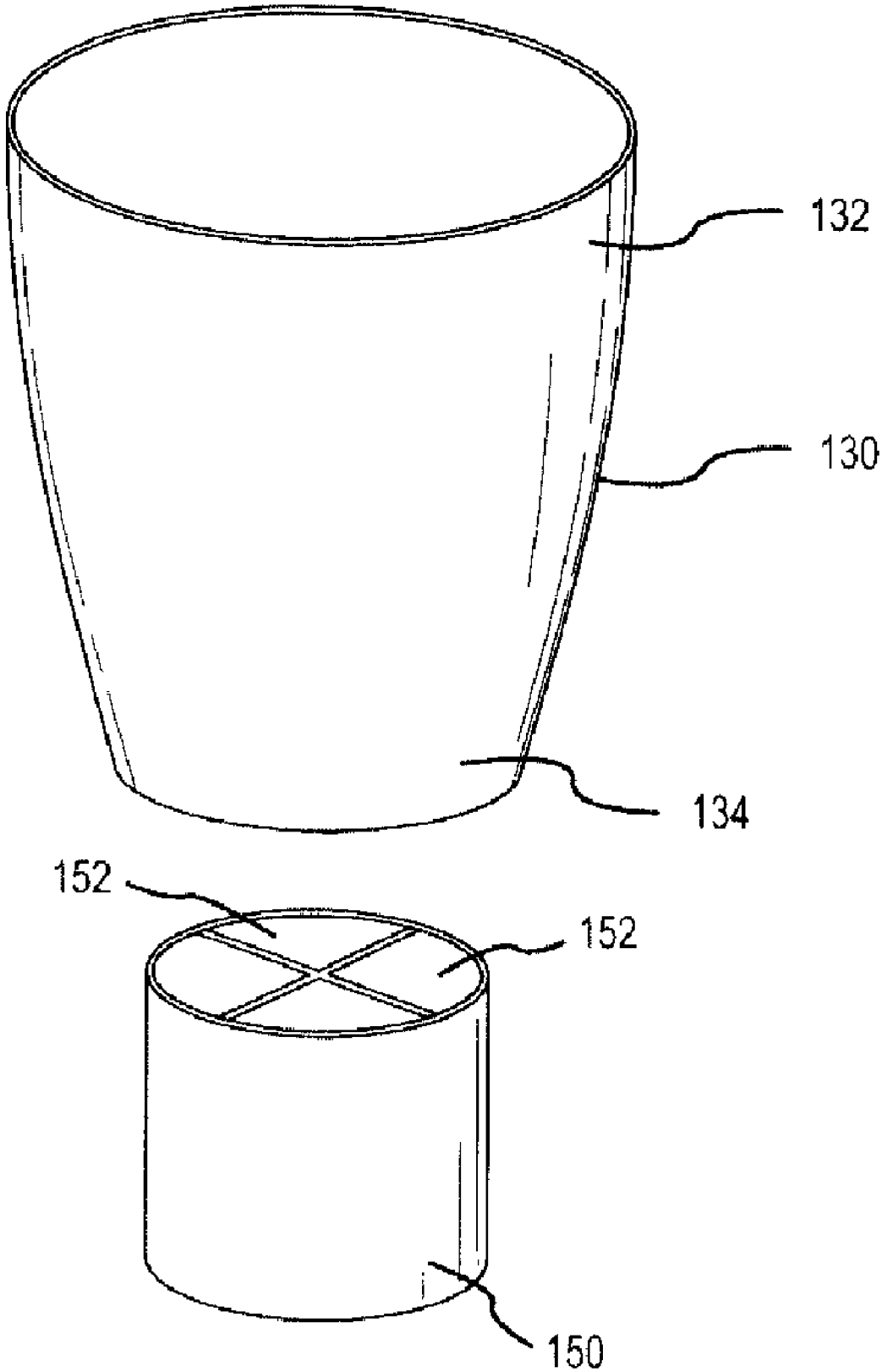
FIG. 7 is a side view of a concentrator optically coupled to a detection device.

The detector 150 receives energy via the concentrator 130 and communicates corresponding signals to the guidance computer system 160. The detector 150 may be configured in any appropriate manner to detect the relevant energy and generate corresponding signals. In the present embodiment, referring to FIG. 7, the detector 150 is positioned at the exit of the concentrator 130 to receive energy from the concentrator 130. For example, the detector 150 may be connected to the exit end of the concentrator 130, which may readily align the detector 150 with the concentrator 130.

The detector 150 may be configured to indicate the direction from which the energy is received, for example to guide the missile to the light source. For example, the detector may generate signals corresponding to the amount of energy striking different parts of the detector 150. In one embodiment, the detector 150 is divided into two or more energy-sensitive sections around a center point of the detector. For example, the present detector 150 is divided into four segments 152 by two perpendicular axes intersecting at the approximate centerpoint of the detector 150 and corresponding to the sections of the concentrator 130 defined by the internal reflectors 136. Alternatively, the number and shape of the various segments 152 may be selected according to any criteria and configuration. In one embodiment, the detector 150 comprises a quad-cell detector. Alternatively, the detector 150 may comprise a grouping of separate detection devices. For example, the detector 150 may comprise multiple, such as four, separate detection devices. The detector 150 may comprise any appropriate energy detection system, such as single-pixel light detectors, photocells, charge-coupled devices, and the like.

Figure 11A:
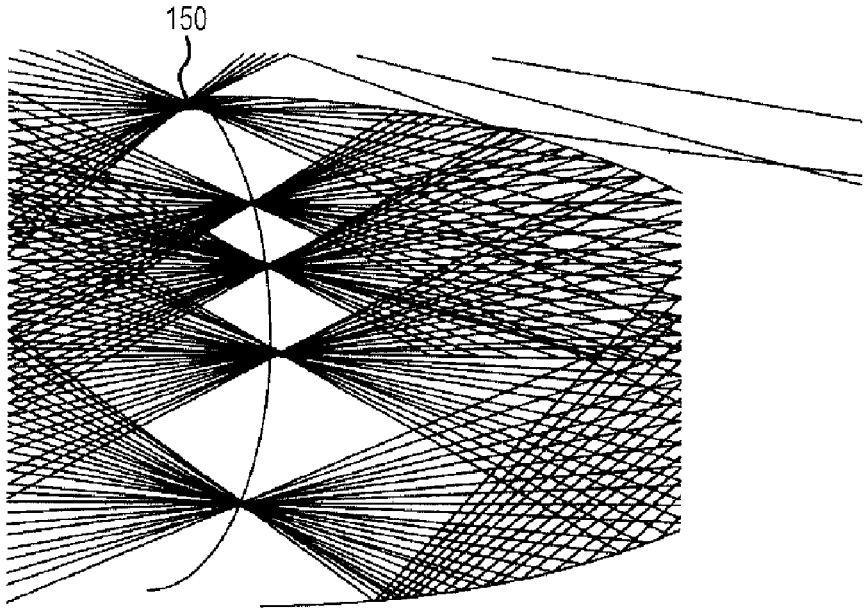
FIGS. 11A-B are a cross-section view of a curved detector surface with a ray diagram and a perspective view of internal reflectors and a curved detector surface, respectively.
Figure 11B:
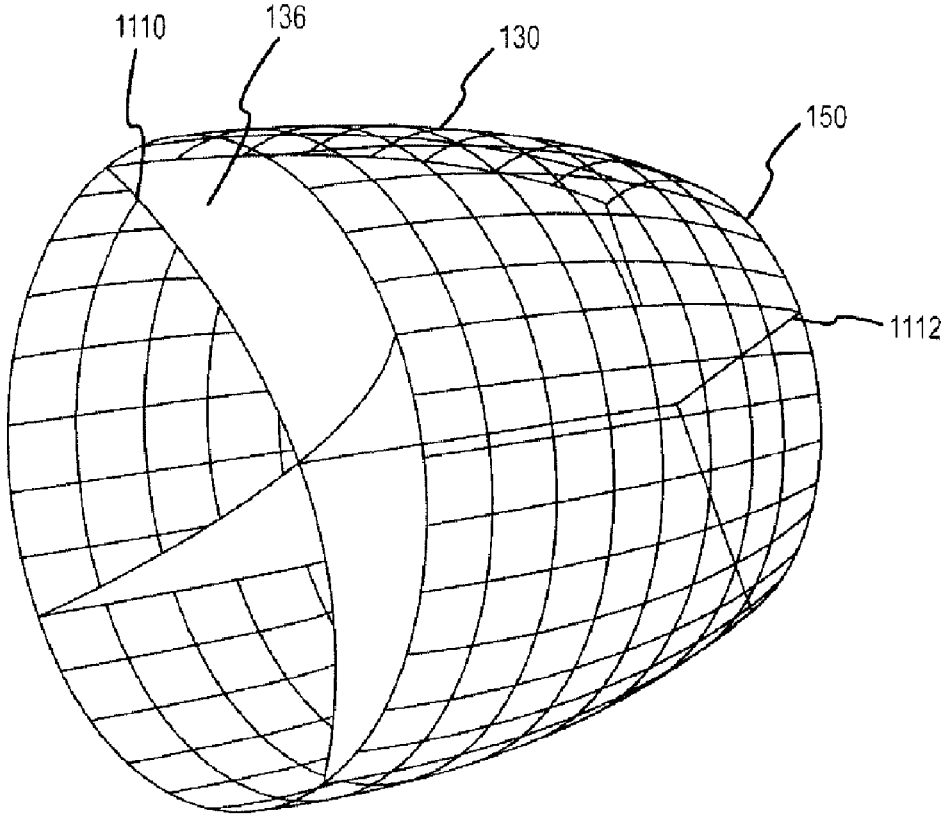

The detector 150 may further include a curved image plane for receiving the energy. For example, referring to FIGS. 11A-B, the detector 150 surface may include a parabolic curve to more effectively map the energy received from the concentrator 130 onto the detector 150. The curved detector 150 surface may decreases aberrations and provide for enhanced scintillation control. In this embodiment, the front and/or rear edges 1110, 1112 of the internal reflectors 136 may likewise be curved.

The detector 150 may generate signals according to the amount of energy received in the different segments 152. Thus, if incoming energy strikes the "southwest" quadrant of the four-area detector 150, the detector may generate a signal corresponding to the southwest quadrant of the detector. In addition, the signal may correspond to the brightness of the energy incident upon the detector. Thus, if both the "southwest" and the "southeast" quadrants receive light in the relevant frequency range, and the relevant light on the southwest quadrant is twice as intense as the light on the southeast quadrant, the detector may generate a first signal corresponding to the light on the southwest quadrant that is twice the magnitude of a second signal corresponding to the southeast quadrant.

Figure 12:
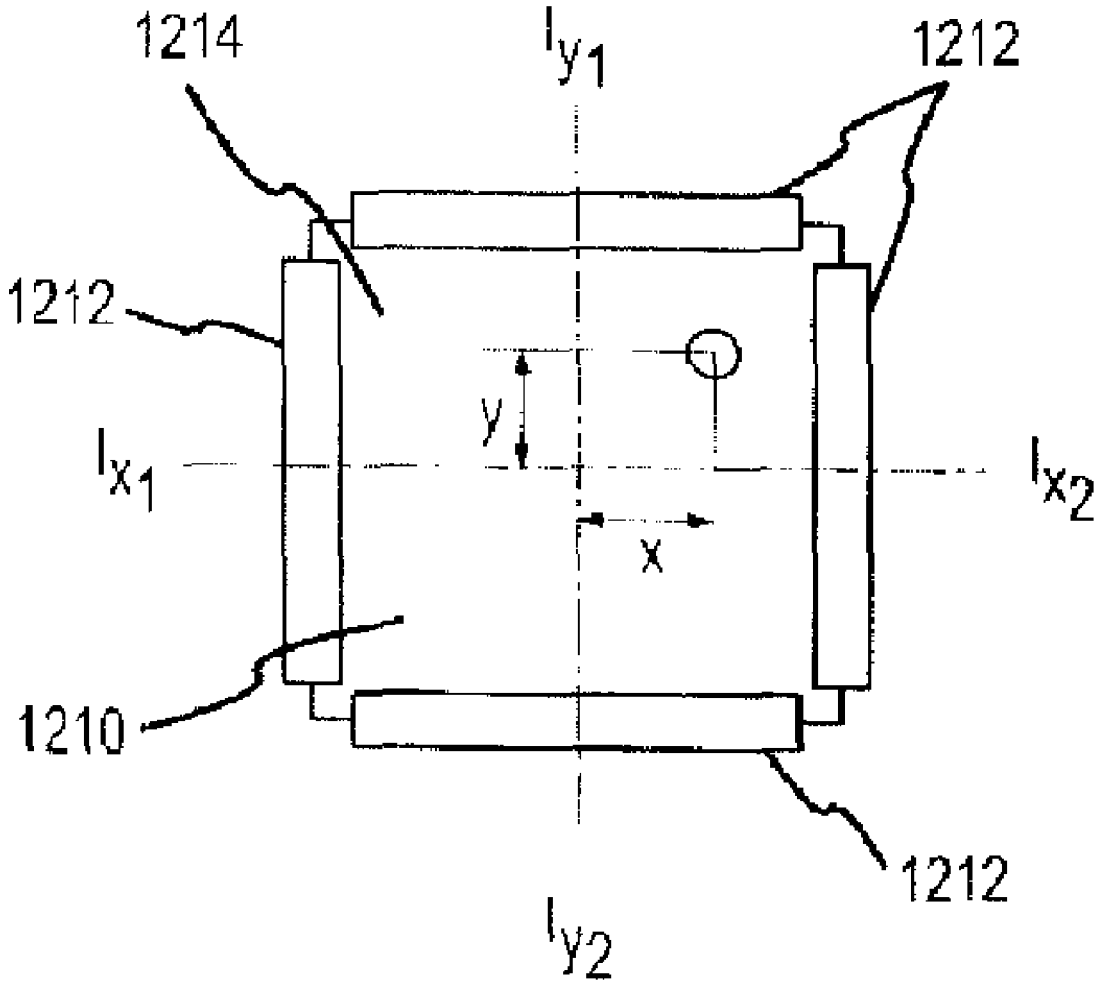
FIG. 12 is an illustration of a lateral effect photodiode.

Alternatively, the detector 150 may directly sense the position of the energy on the detector 150. For example, referring to FIG. 12, the detector 150 may comprise a position sensitive detector, such as a lateral effect photodiode (LEP) 1210 comprising electrodes 1212 along opposite edges of an active area 1214. A photocurrent is generated in response to energy on the active area 1214, which is proportional to the distance of the energy location relative to one edge to the total distance between the electrodes. The detector 150 may operate in a one-dimensional, two-dimensional, or other configuration.

The guidance computer system 160 receives the signals from the detector 150 and controls the control surfaces to guide the missile to the energy source. The guidance computer system 160 may comprise any guidance controller for receiving information from the detector 150 and guiding the missile 110. As the detector 150 communicates information to the guidance computer system 160, the computer system 160 analyzes that data and, if necessary, transmits guidance information to the missile 110. The missile 110 may then alter its flight-control mechanisms accordingly. These communications may include alterations to the missile's 110 control surfaces or adjusting the power source to change the missile's 110 speed.

The guidance computer system 160 may calculate guidance information by analyzing data generated by each of the detector's 150 detector segments 152, for example according to the ratio of energy distribution among the segments 152 on the detector 150.

By comparing the amount of energy detected by each of the four detector segments 152, the guidance computer system 160 may determine the bearing and possibly the range of the source of any energy and direct the missile 10 accordingly. The guidance computer system 160 may generate a guidance signal corresponding to the amount of flight path adjustment required to track the target. If the guidance signal has a value of zero, then the missile is on target. Accordingly, the guidance computer system 160 may attempt to drive the guidance signal to zero. In a detector 150 having four detector segments 152 labeled A, B, C and D, the guidance signal can be calculated as follows:

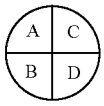

$$GuidanceSignal(\text{vertical}) = \frac{(A+C)-(B+D)}{\sum(A+B+C+D)}$$

$$GuidanceSignal(\text{horizontal}) = \frac{(A+B)-(C+D)}{\sum(A+B+C+D)}$$

For detectors 150 having alternative detector segment 152 configurations, different guidance signal equations can be developed that may be used by the guidance computer system 160 to assist in targeting of the missile 110. For example, referring again to FIG. 12, the position sensitive detector may generate the guidance signal as follows:

$$GuidanceSignal(\text{horizontal}) = \frac{(I_{x2}-I_{x1})}{(I_{x1}+I_{x2})}$$

$$GuidanceSignal(\text{vertical}) = \frac{(I_{y2}-I_{y1})}{(I_{y1}+I_{y2})}$$

For trough compound parabolic concentrator 130 configurations, the guidance computer system 160 may receive additional information. For example, referring to FIG. 9, the concentrator 130 may be divided into two or more zones along the length of the concentrator 130. The trough concentrator 130 may track the angle of the incoming energy along the length of the concentrator 130 by identifying the magnitude of the incident energy in each zone. Additional guidance information may be generated by rotating the concentrator 130 during flight, for example around an axis that lies parallel to the missile trajectory.

When the missile is launched, the missile may generally travel in the direction of the target. As the missile gains a line of sight on the target, a light source on the target, such as light from a targeting laser reflected from the target, becomes visible. Light from the light source is transmitted by the lens into the concentrator 130. If the incident light exceeds the acceptance angle, the light bounces back out of the concentrator 130. If the light enters the concentrator 130 within the acceptance angle, the concentrator 130 transmits the light through the exit. The internal reflectors 136 may also confine the light to the same section of the concentrator 130.

Light exiting the concentrator 130 strikes the detector 150. The detector 150 generates signals corresponding to the sections 152 of the detector 150 receiving the light, the angle of incidence based on the distance of the light from the center, and/or the intensity of the light on the areas 152 of the detector 150. The guidance computer system 160 may then adjust the flight path according to the signals.

In the foregoing specification, the invention has been described with reference to specific exemplary embodiments. Various modifications and changes may be made without departing from the scope of the present invention as set forth in the claims below. The specification and figures are to be regarded in an illustrative manner, rather than a restrictive one. Accordingly, the scope of the invention should be determined by the claims and their legal equivalents rather than by merely the examples described above.

For example, the steps recited in any method or process claims may be executed in any order and are not limited to the specific order presented in the claims. Additionally, the components and/or elements recited in any apparatus claims may be assembled or otherwise operationally configured in a variety of permutations to produce substantially the same result as the present invention and are accordingly not limited to the specific configuration recited.

Benefits, other advantages and solutions to problems have been described above with regard to a particular embodiment. Any benefit, advantage, solution to a problem or any element that may cause any particular benefit, advantage or solution to occur or to become more pronounced are not to be construed as critical, required or essential features or components of any or all the claims.

The terms "comprise", "comprises", "comprising", "having", "including", "includes" or any variation thereof, are intended to reference a non-exclusive inclusion, such that a process, method, article, composition or apparatus that comprises a list of elements does not include only those elements recited, but may also include other elements not expressly listed or inherent to such process, method, article, composition or apparatus. Other combinations and/or modifications of the above-described structures, arrangements, applications, proportions, elements, materials or components used in the practice of the present invention, in addition to those not specifically recited, may be varied or otherwise particularly adapted to specific environments, manufacturing specifications, design parameters or other Operating requirements without departing from the general principles.

The invention claimed is:

1. A guidance system for a guided projectile, comprising:

an energy concentrator defining an entrance and an exit, wherein the energy concentrator is configured to:

allow an energy entering the entrance to pass through the exit if the energy enters the entrance within a predetermined acceptance angle; and reject the energy entering the entrance if the energy enters the entrance outside the predetermined acceptance angle; and a detector coupled to the exit of the energy concentrator and configured to generate signals corresponding to a location of the transmitted energy incident upon the detector.

2. A guidance system according to claim 1, further comprising a guidance controller coupled to the detector, wherein the guidance controller is configured to receive the signal from the detector and control a trajectory of the projectile according to the signal.

3. A guidance system according to claim 1, wherein the energy concentrator comprises a compound parabolic concentrator.

4. A guidance system according to claim 1, wherein the energy concentrator comprises a non-imaging concentrator.

5. A guidance system according to claim 1, wherein the energy concentrator comprises a trough concentrator.

6. A guidance system according to claim 1, wherein the energy concentrator comprises an inner portion comprising a dielectric material.

7. A guidance system according to claim 1, further comprising an internal reflector disposed within the concentrator and defining a plurality of sections, wherein the internal reflector confines energy entering the entrance to a single section.

8. A guidance system according to claim 7, wherein the internal reflector extends from the entrance to the exit.

9. A guidance system according to claim 1, further comprising a lens coupled to the energy concentrator.

10. A guidance system according to claim 1, wherein the detector comprises a plurality of energy-sensitive areas, and the detector is configured to:

receive the energy transmitted through the exit on at least one of the energy-sensitive areas; and generate a signal corresponding to the location of the at least one of the energy-sensitive areas receiving the transmitted energy.

11. A guidance system according to claim 1, wherein the detector defines four energy-sensitive areas.

12. A guidance system according to claim 1, further comprising a second energy concentrator defining an entrance and an exit, wherein the exit of the second energy concentrator is coupled to the entrance of the first energy concentrator.

13. A guided projectile, comprising:

a projectile body;

a guidance controller within the body;

a control surface connected to the body and responsive to the guidance controller; and an energy detection system, comprising:

an energy detector coupled to the guidance controller, wherein the energy detector is configured to provide signals to the guidance controller corresponding to a location upon the energy detector receiving a radiant energy; and an energy concentrator coupled to the energy detector and configured to allow the radiant energy to pass to the energy detector if the radiant energy enters the energy concentrator within an acceptance angle and reject the radiant energy if the energy enters the energy concentrator outside the acceptance angle.

14. A guided projectile according to claim 13, wherein the energy concentrator comprises a compound parabolic concentrator.

15. A guided projectile according to claim 13, wherein the energy concentrator comprises a non-imaging concentrator.

16. A guided projectile according to claim 13, wherein the energy concentrator comprises a trough concentrator.

17. A guided projectile according to claim 13, wherein the energy concentrator comprises an inner portion comprising a dielectric material.

18. A guided projectile according to claim 13, further comprising an internal reflector disposed within the concentrator and defining a plurality of sections, wherein the internal reflector confines energy entering the entrance to a single section.

19. A guided projectile according to claim 18, wherein the internal reflector extends from an entrance of the energy concentrator to an exit of the energy concentrator.

20. A guided projectile according to claim 13, wherein the detector comprises a plurality of energy-sensitive areas, and the detector is configured to:

receive the energy transmitted by the concentrator on at least one of the energy-sensitive areas; and generate a signal corresponding to the location of the at least one of the energy-sensitive areas receiving the transmitted energy.

21. A guided projectile according to claim 13, wherein the detector defines four energy-sensitive areas.

22. A guided projectile according to claim 13, further comprising a second energy concentrator defining an entrance and an exit, wherein the exit of the second energy concentrator is coupled to the entrance of the first energy concentrator.

23. A method for guiding a projectile, comprising:

receiving energy from a target at an incident angle by an energy concentrator;

rejecting the energy if the incident angle is greater than a predetermined acceptance angle by the energy concentrator;

allowing the energy to pass to a detector if the incident angle is equal to or less than the predetermined acceptance angle by the energy concentrator;

generating a signal by the detector corresponding to a location on the detector receiving the energy; and adjusting the path of the projectile based on the signal.

24. A method according to claim 23, wherein the energy concentrator comprises a compound parabolic concentrator.

25. A method according to claim 23, wherein the energy concentrator comprises a non-imaging concentrator.

26. A method according to claim 23, wherein the energy concentrator comprises a trough concentrator.

27. A method according to claim 23, further comprising confining the energy to one of a plurality of sections within the energy concentrator.

28. A method according to claim 23, wherein the detector comprises a plurality of energy-sensitive areas, and generating the signal comprises:

receiving the energy passed to at least one of the energy-sensitive areas; and generating a signal corresponding to the location of the at least one of the energy-sensitive areas receiving the transmitted energy.

* * * * *